US006948216B2

(12) United States Patent
Gaudyn et al.

(10) Patent No.: US 6,948,216 B2
(45) Date of Patent: Sep. 27, 2005

(54) WINDOW COVERING WITH IMPROVED ANCHOR FOR OPERATING CORD

(75) Inventors: Erwin Gaudyn, Westminster, CO (US); Stephen T. Wisecup, Erie, CO (US); Terry L. Akins, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/464,097

(22) Filed: Jun. 17, 2003

(65) Prior Publication Data

US 2004/0064918 A1 Apr. 8, 2004

Related U.S. Application Data

(60) Provisional application No. 60/390,020, filed on Jun. 17, 2002.

(51) Int. Cl.[7] ..... E06B 9/38

(52) U.S. Cl. ..... 16/205; 16/208; 160/178.1 R; 160/84.01; 24/115 R

(58) Field of Search ..... 16/202, 205, 208, 16/203; 160/178.2, 167 R, 173 R, 174 R, 168.1 R, 178.1 R, 84.01, 84.05; 24/130, 129 R, 136 L, 115 R

(56) References Cited

U.S. PATENT DOCUMENTS

| | | | | |
|---|---|---|---|---|
| 1,570,291 A | | 1/1926 | Alstine | |
| 2,296,082 A | | 9/1942 | Bierk | 24/130 |
| 2,316,950 A | | 4/1943 | Goeller | 211/119.15 |
| 2,443,335 A | * | 6/1948 | Vogel | 24/136 L |
| 3,631,570 A | * | 1/1972 | Coleman | 24/129 R |
| 3,766,610 A | * | 10/1973 | Thorsbakken | 403/211 |
| 4,112,551 A | * | 9/1978 | Sales | 24/712.5 |
| 4,177,542 A | * | 12/1979 | Denney | 24/115 R |
| 4,782,560 A | * | 11/1988 | Keller | 24/136 L |
| 5,345,656 A | * | 9/1994 | Merritt | 24/115 H |
| 5,560,414 A | * | 10/1996 | Judkins et al. | 160/178.1 R |
| 5,621,952 A | * | 4/1997 | Frano | 24/115 G |
| 5,666,699 A | * | 9/1997 | Takahashi | 24/115 G |
| 6,059,004 A | * | 5/2000 | Oskam | 160/84.04 |
| 6,119,757 A | * | 9/2000 | Judkins et al. | 160/173 R |

FOREIGN PATENT DOCUMENTS

| | | |
|---|---|---|
| DE | 72 28 454.9 | 10/1972 |
| DE | 2 238 417 | 2/1974 |
| EP | 0 192 867 | 9/1986 |
| GB | 1006420 | 9/1965 |
| SE | 311 994 | 6/1969 |

* cited by examiner

*Primary Examiner*—Chuck Y. Mah
*Assistant Examiner*—Michael J. Kyle
(74) *Attorney, Agent, or Firm*—Dorsey & Whitney LLP

(57) ABSTRACT

A covering for an architectural opening includes a head rail, a bottom rail, and a blind material extending therebetween in addition to an operating element or lift cord extending from the head rail to the bottom rail and an improved anchoring system for securing the lower free end of the lift cord to the bottom rail. The anchor includes a body adapted to be inserted into an opening in the bottom rail with the body having radiating ribs at one end defining passages therebetween such that the lift cord can be selectively wrapped around the ribs in a predetermined manner to secure the lift cord to the anchor at a predetermined location along the length of the lift cord. A cap is provided on the anchor for further securing the cord to the body by pinching the cord between the cap and an internal surface of the body.

16 Claims, 9 Drawing Sheets

WINDOW COVERING WITH IMPROVED ANCHOR FOR OPERATING CORD

CROSS REFERENCE TO RELATED APPLICATIONS

This application claims the benefit of U.S. provisional application No. 60/390,020, filed Jun. 17, 2002, and is hereby incorporated by referenced as if fully disclosed herein.

BACKGROUND OF THE INVENTION

1. Field of the Invention

The present invention relates generally to coverings for architectural openings and more particularly to an anchor for securing one end of an operating cord for the covering in a bottom rail or other component of the covering.

2. Description of the Relevant Art

Retractable coverings for architectural openings such as windows, doors, archways, or the like, typically include a head rail, a bottom rail, and a blind material extending between the head rail and bottom rail. The blind material can be many different materials such as sheets of fabric, horizontal slats as found in Venetian blinds, cellular shade material or the like. The covering further typically includes at least one operating element which can be in the form of a cord, tape, or the like, with some of the operating elements extending from the head rail to the bottom rail and being operative to lift the bottom rail toward the top rail thereby causing the blind material to fold or collapse therebetween.

As will be appreciated, it is desirable that the bottom rail remain parallel to the top rail and to the frame or still of the architectural opening in which the covering is mounted. Accordingly, systems have been designed for connecting the operative element to the bottom rail at a predetermined location along the length of a plurality of corresponding operative elements. Typically there are more than one operative element connecting the head rail to the bottom rail in order to maintain a parallel relationship between the head rail and bottom rail. Accordingly, each operative element needs to have an identical effective length between the head rail and bottom rail in order to maintain the parallel relationship.

In conventional coverings for architectural openings, the operative elements may be connected to the bottom rail simply by passing the element through a hole in the bottom rail and tying a knot in the element at the desired location along the length of the cord. As will be appreciated, however, it is difficult to tie a knot at a precise location along the length of a cord or the like and, accordingly, it is difficult to obtain precisely the same effective length in each operative element. Attempts to improve on that system have included the use of a pocket-type insert in the bottom rail through which the operative element can be passed and the insertion of a ferrule into the pocket to pinch the operating cord at the predetermined location along the length of the operative element. Such systems are more effective than simply knotting the operative elements, but as will be appreciated, it is difficult to hold the operative element at a precise location along its length relative to the pocket when inserting the ferrule into the pocket and accordingly, this system has also proven to be less than fully satisfactory.

It is to overcome shortcomings in prior art systems for connecting operative elements of coverings for architectural openings to operative components of the covering that the present invention has been developed.

BRIEF SUMMARY OF THE INVENTION

The present invention relates to an improved system for connecting an operative element, such as a lift cord, of a covering for an architectural opening to the bottom rail of the covering or any other operative component of the covering. The system includes an anchor for connection to the bottom rail having an elongated hollow body with one open end and an opposite end provided with at least one rib so as to define a plurality of passages through the opposite end. A cap is provided for selectively closing the open end to pinch the lift cord between the elongated body and the cap once the cord has been properly positioned along its length relative to the elongated body.

The anchor is designed such that the cord can be wrapped around one or more of the ribs in the elongated body and selectively moved along its length relative to the elongated body in a simplified manner. Each rib has edges of different configurations with some edges being designed to grip the cord and other edges being contoured to allow easy slippage of the cord relative to the rib. The varying configurations of the edges of the ribs allow the cord to be moved and selectively anchored at any desired location along the length of the cord in a simple manner and once the cord has been desirably positioned relative to the elongated body, the cap is inserted into the open end of the elongated body to pinch and otherwise trap a free end of the cord that is adjacent to the elongated body.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1A:
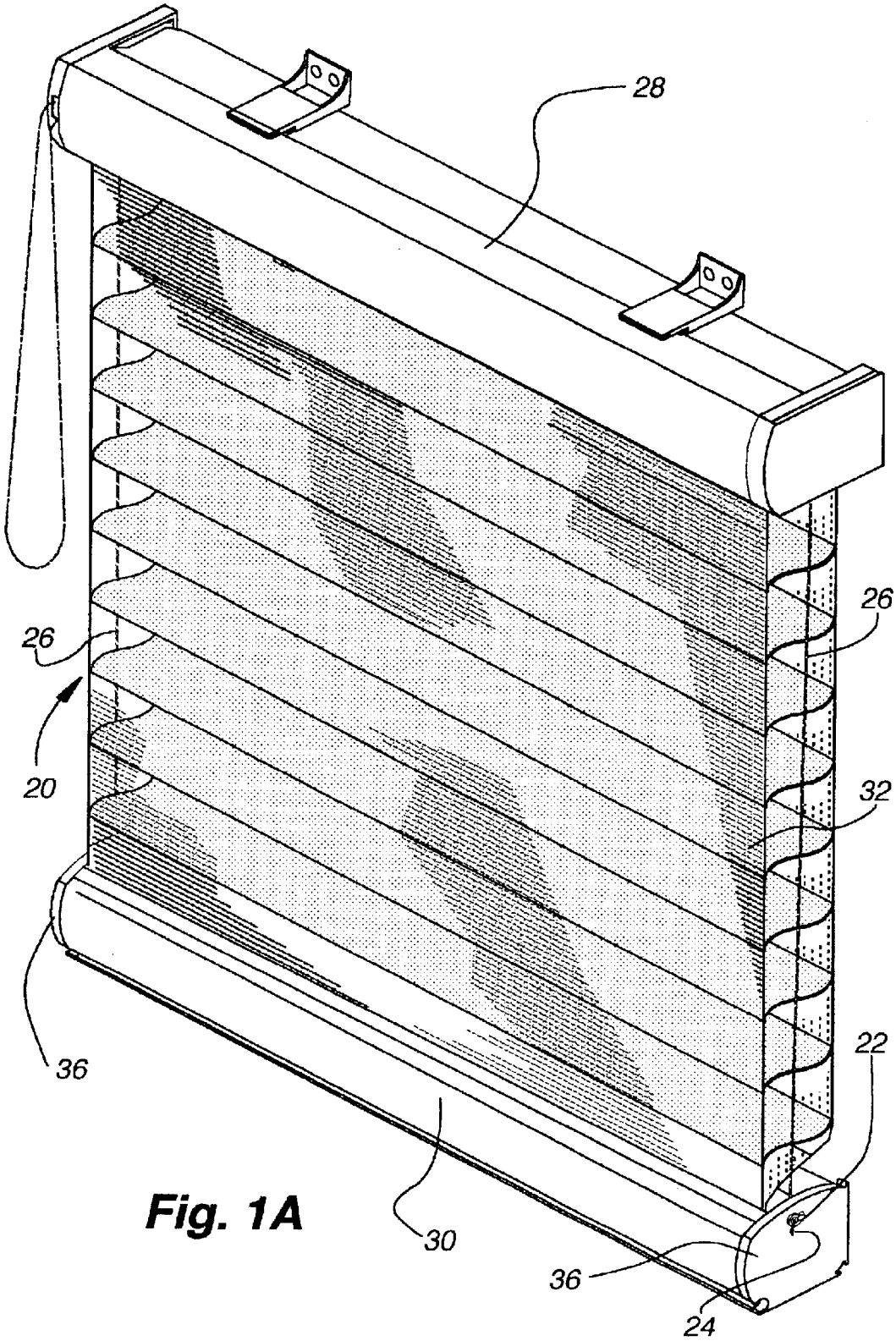
FIG. 1A is an isometric view of a covering for an architectural opening incorporating the anchor system of the present invention for securing an operative element to an operative component of the opening.
Figure 3:
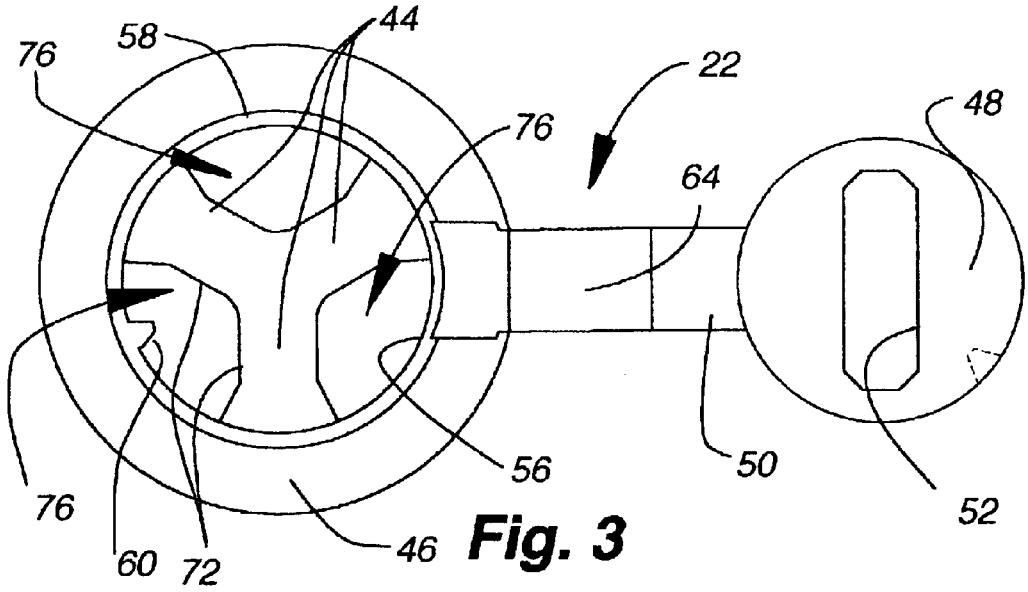
FIG. 3 is a top plan view of the anchor shown in FIG. 1.
Figure 4:
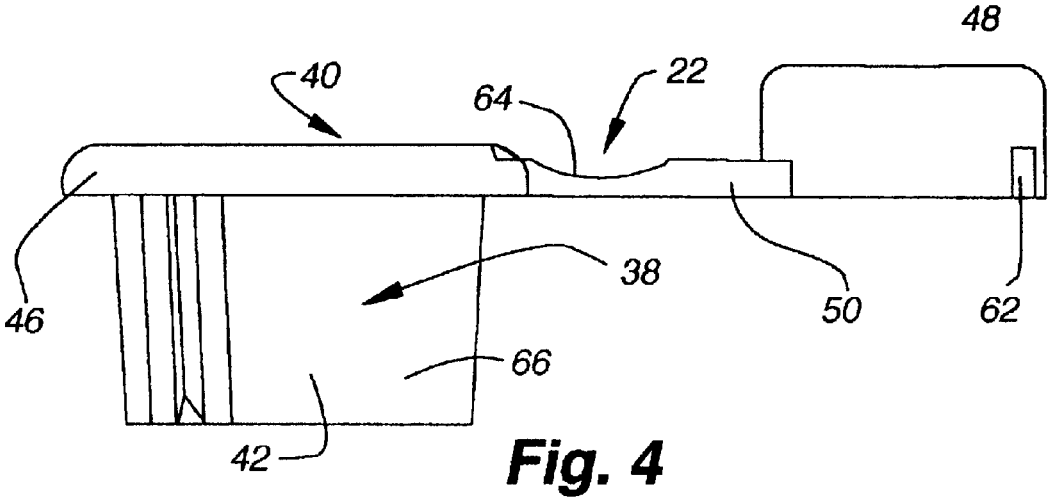
FIG. 4 is a side elevation of the anchor as seen in FIG. 3.

With reference first to FIG. 1A, a covering 20 for an architectural opening (not shown) is illustrated that encompasses the anchor 22 of the present invention for securing a free end 24 of an operative element to an operative component of the covering. The covering can be seen to include a head rail 28, a bottom rail 30, and a blind material 32 extending therebetween. The blind material could be any material commonly found in coverings for architectural openings such as sheets of fabric, cellular material, Venetian blind slats, or the like. As in most retractable coverings for architectural openings, the covering further includes operative elements 26 in the form of elongated cords, ribbons, tapes or the like that are used for many purposes, but in the illustrated embodiment, as a lift cord that extends from the headrail to the bottom rail with the lower free end 24 of the lift cord being secured to the bottom rail with the anchor of the present invention. While the lift cord 26 will be described as being connected to the bottom rail 30 of the covering, it will also be appreciated that the anchor 22 of the present invention would be useful in securing any operative element to any operative component of a covering and at any location on the operative component.

The bottom rail 30 of the covering has openings 34 in opposite ends 36 thereof adjacent to the two lift cords 26 shown in use in the covering. The number of lift cords typically depends on the size of the covering but there will always be at least two lift cords so that the bottom rail can be lifted and maintained in parallel relationship with the head rail 28 as well as the sill or other frame component of the architectural opening in which the covering is mounted. The lift cords extend downwardly and through the associated openings 34 in the bottom rail and are secured to the ends 36 of the bottom rail with the anchor 22 of the present invention. It should be noted the openings 34 do not need to be in the ends of the bottom rail but could be at other locations such as a bottom wall of the bottom rail.

As is best seen in FIGS. 1–5, the anchor 22 used to secure the free lower end 24 of the pull cord 26 to the bottom rail includes a hollow, cylindrical body 38 having an open top end 40 and a spoked bottom end 42 having a plurality of radiating ribs 44. An outwardly directed flange 46 extends peripherally around the open top end of the body and a cap 48 is integrally connected with the flange through a flexible neck 50 with the cap being in the form of a cylindrical plug having a slot 52 therethrough.

As will be appreciated, a generally cylindrical passage 54 having a cylindrical surface 56 is defined through the hollow body 38 with the surface 56 at the open top end 40 of the body being flared or beveled outwardly at 58. The diameter of the cylindrical cap 48 is predetermined such that the cylindrical cap can be inserted into the open top end of the body and be frictionally retained therein, however, the surface 56 also has an inwardly directed bead 60 near the open top end 40 of the body that cooperates with a recess 62 in the outer wall of the cap to more securely releasably retain the cap in the passage 54. The slot 52 through the cap is of a size to receive a screwdriver head so that the cap can be selectively removed from its retained relationship with the body. The cap of course always remains connected to the body via the integral neck 50. As is best appreciated by reference to FIG. 6, the neck has a recess 64 in the top surface thereof to facilitate easy flexing of the neck at that location so the cap can be easily pivoted into aligned relationship with the passage 54 in the hollow body. The anchor 22 can be made of any suitable material even though polycarbonates or the like have been found to be particularly well suited.

Figure 1:
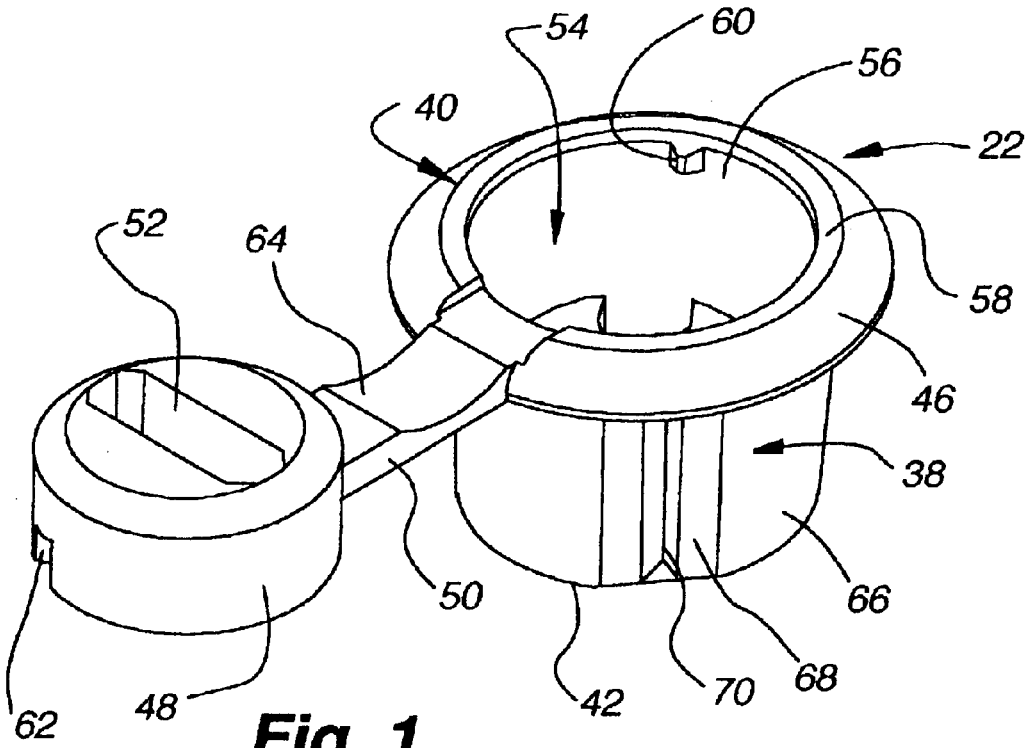
FIG. 1 is an isometric view looking downwardly toward the top of the anchor of the present invention for securing an operative element.
Figure 2:
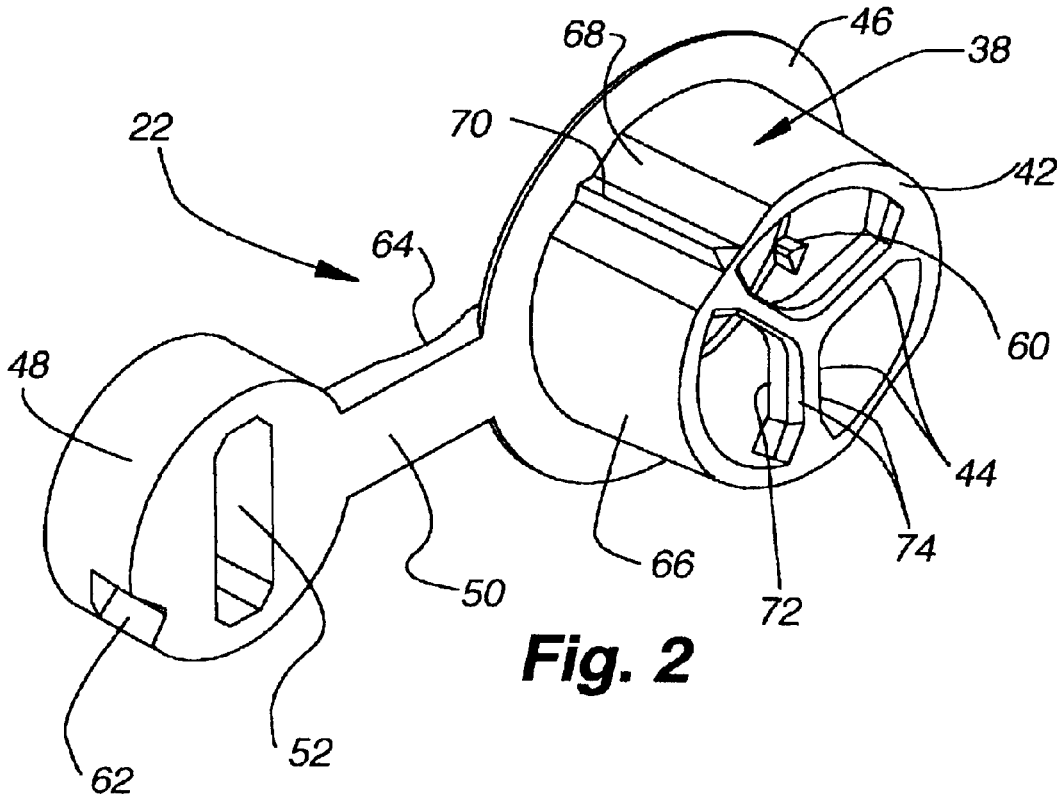
FIG. 2 is an isometric view similar to FIG. 1 looking upwardly toward the bottom of the anchor.
Figure 5:
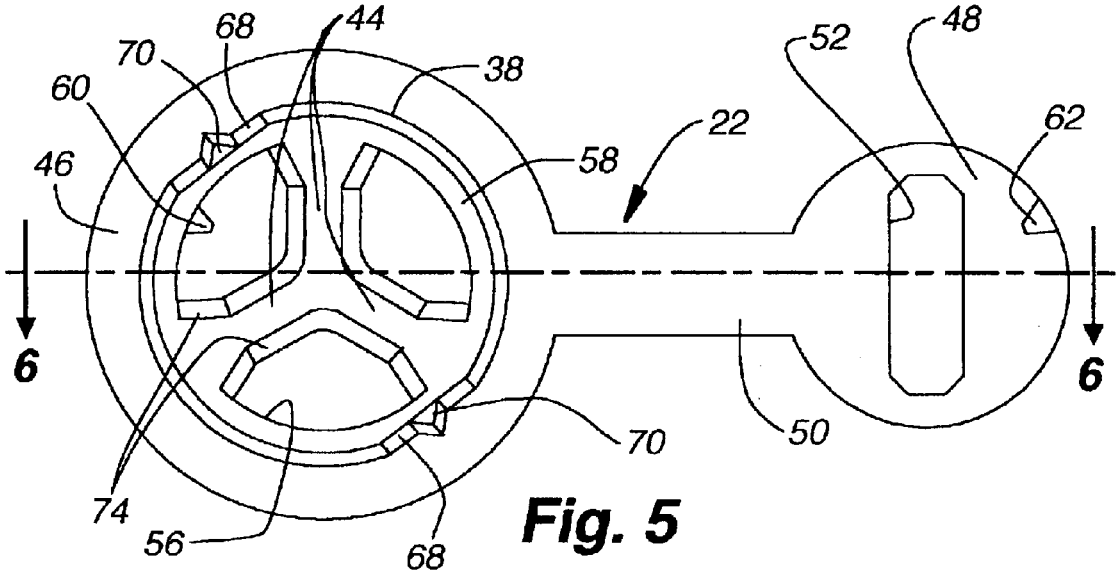
FIG. 5 is a bottom plan view of the anchor similar to FIG. 3.

As is probably best appreciated by reference to FIGS. 2 and 5, the outer surface 66 of the cylindrical body 38 is provided with diametrically opposed longitudinally extending recesses 68 in which relatively sharp longitudinally extending ribs 70 are formed. The ribs 70 extend a slightly greater distance radially outwardly from the longitudinal centerline of the cylindrical body than the radius of the outer surface 66 of the main body for a purpose to be described later.

The spoked bottom end 42 of the body 38 is illustrated as having three equally spaced radiating ribs 44 of generally square cross-section even though any number of ribs could be suitable. The provision of three ribs is preferred for reasons that will become more clear later with a description of the attachment of the lift cord 26 to the anchor 22.

Figure 6:
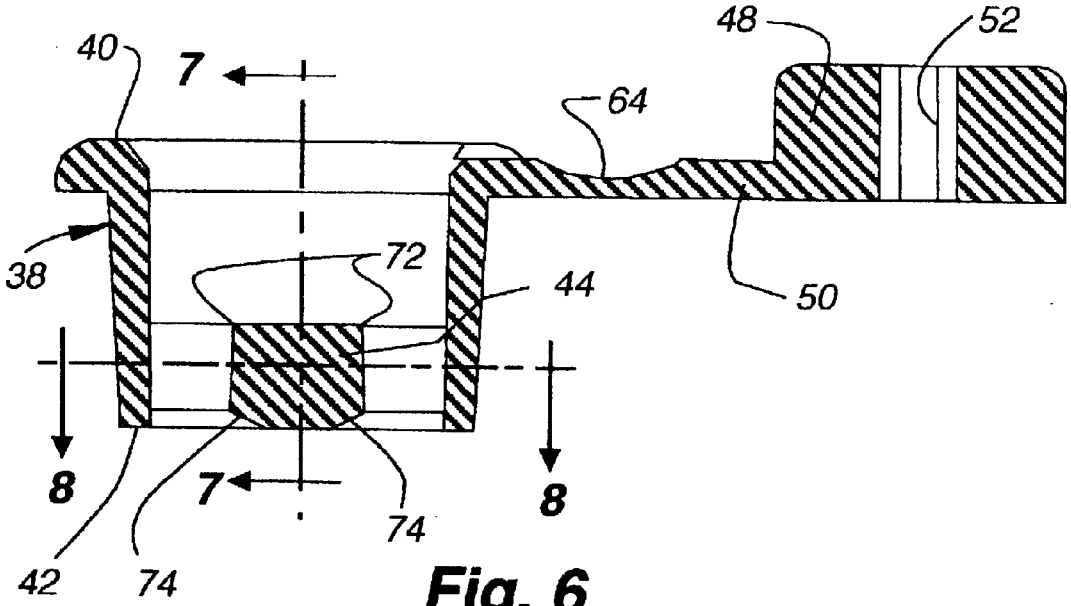
FIG. 6 is a section taken along line 6—6 of FIG. 5.
Figure 7:
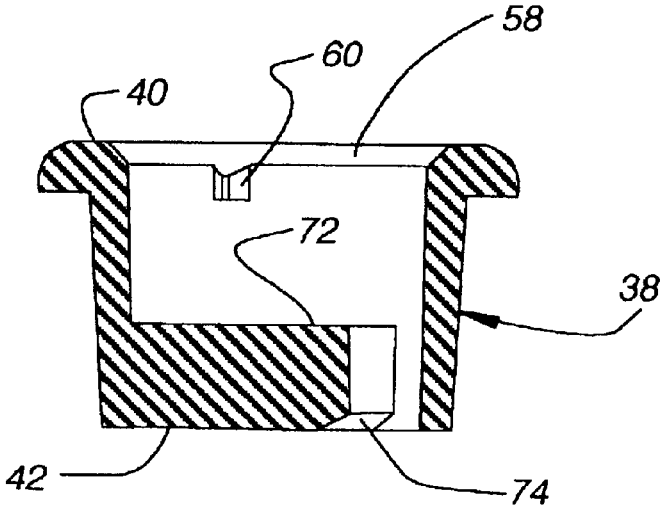
FIG. 7 is a section taken along line 7—7 of FIG. 6.
Figure 8:
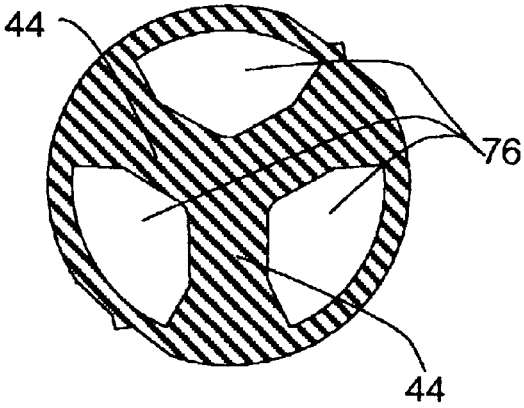
FIG. 8 is a section taken along line 8—8 of FIG. 6.

As is probably best illustrated in FIGS. 6 and 7, each rib 44 has four longitudinal edges with the top edges 72 of each rib being squared. The bottom edges 74 of each rib are beveled. As will be appreciated later, the beveled edges provide a relatively smooth surface across which a lift cord 26 can easily slide whereas the squared edges are designed to selectively grip a lift cord extending thereover. A plurality of passageways 76 through the bottom end 42 are defined between the ribs 44 to permit the passage of a lift cord 26 in a manner to be described later and the ribs are thickened at their connection to the surface 56 of the cylindrical body 38 for reinforcement purposes.

It should be appreciated that the cross-sectional shape of the main body 38 does not necessarily have to be cylindrical as a square configuration, for example as shown in FIGS. 20–23, would also be suitable. The anchor 78 would again have a main body 80 having an open top end 82 and a bottom end 84 with ribs 86 radiating to the side walls of the main body 80 from a central location so as to define passageways 88 therebetween. A neck 90 would again connect a cap 92 of square cross-section to the main body.

Referring back to FIGS. 1–19, the diameter of the cylindrical body 38, or the distance from one corner to another of the square body 80, is substantially the same as the diameter of the opening 34 in the bottom rail 30 in which the anchor 22 is adapted to be seated. The manner of connecting the anchor to the bottom rail is illustrated in FIGS. 9–15. In referencing these figures, it should be appreciated that the open top end 40 of the anchor is shown closer to the top of the page, but when the anchor is inserted into the opening 34 in the end 36 of the bottom rail, it is actually rotated 90° so that the top of the anchor points away from the end 36 of the bottom rail in which it is mounted.

Figure 9:
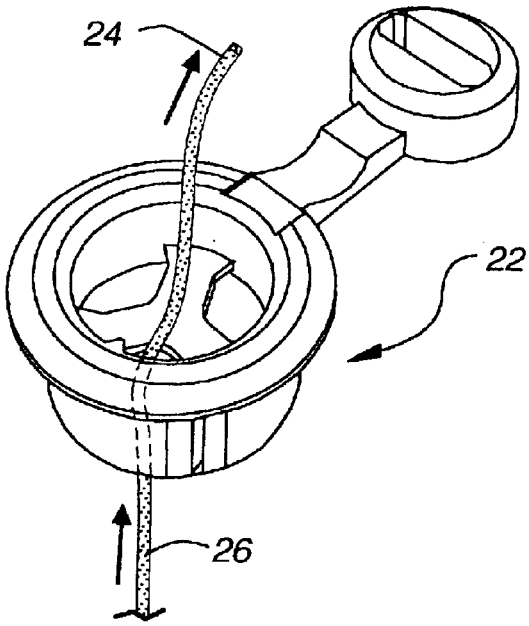
FIGS. 9–12 are isometric operational views showing the threading of an operative element into the anchor of FIG. 1.
Figure 10:
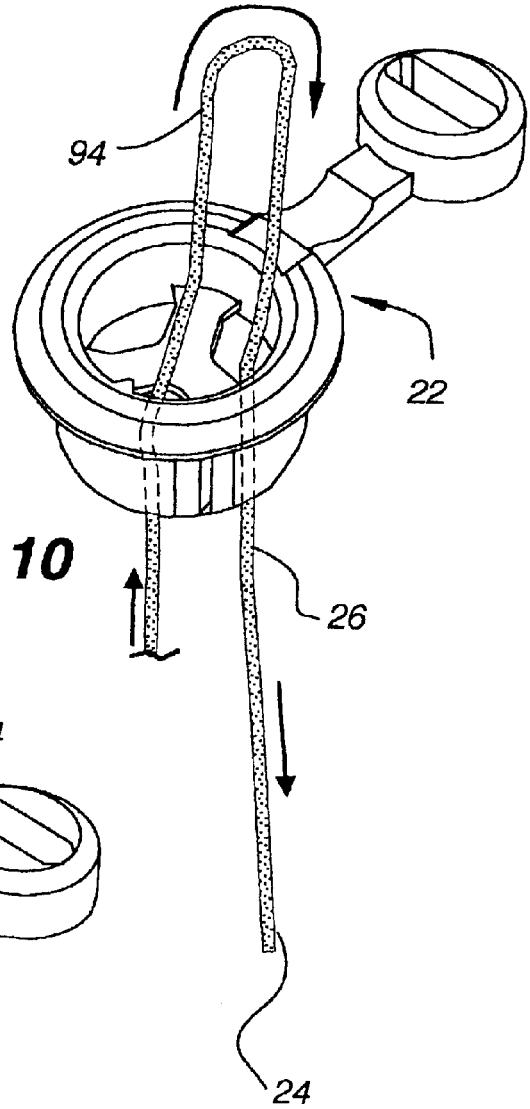

To thread the lift cord 26 through the anchor 22, the free end 24 of the lift cord is first inserted through a passage 76 in the bottom end 42 of the body so the free end of the lift cord extends upwardly through the open top end 40 of the body as shown in FIG. 9. Subsequently, the free end 24 is reinserted downwardly into the body 38 as shown in FIG. 10 so that it passes through a different passage 76 in the bottom wall of the body.

Figure 11:
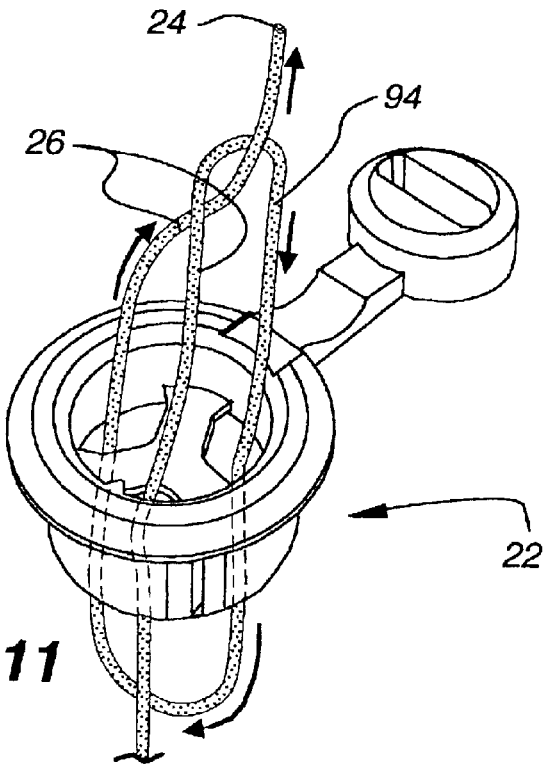
Figures 12, 13, 14:
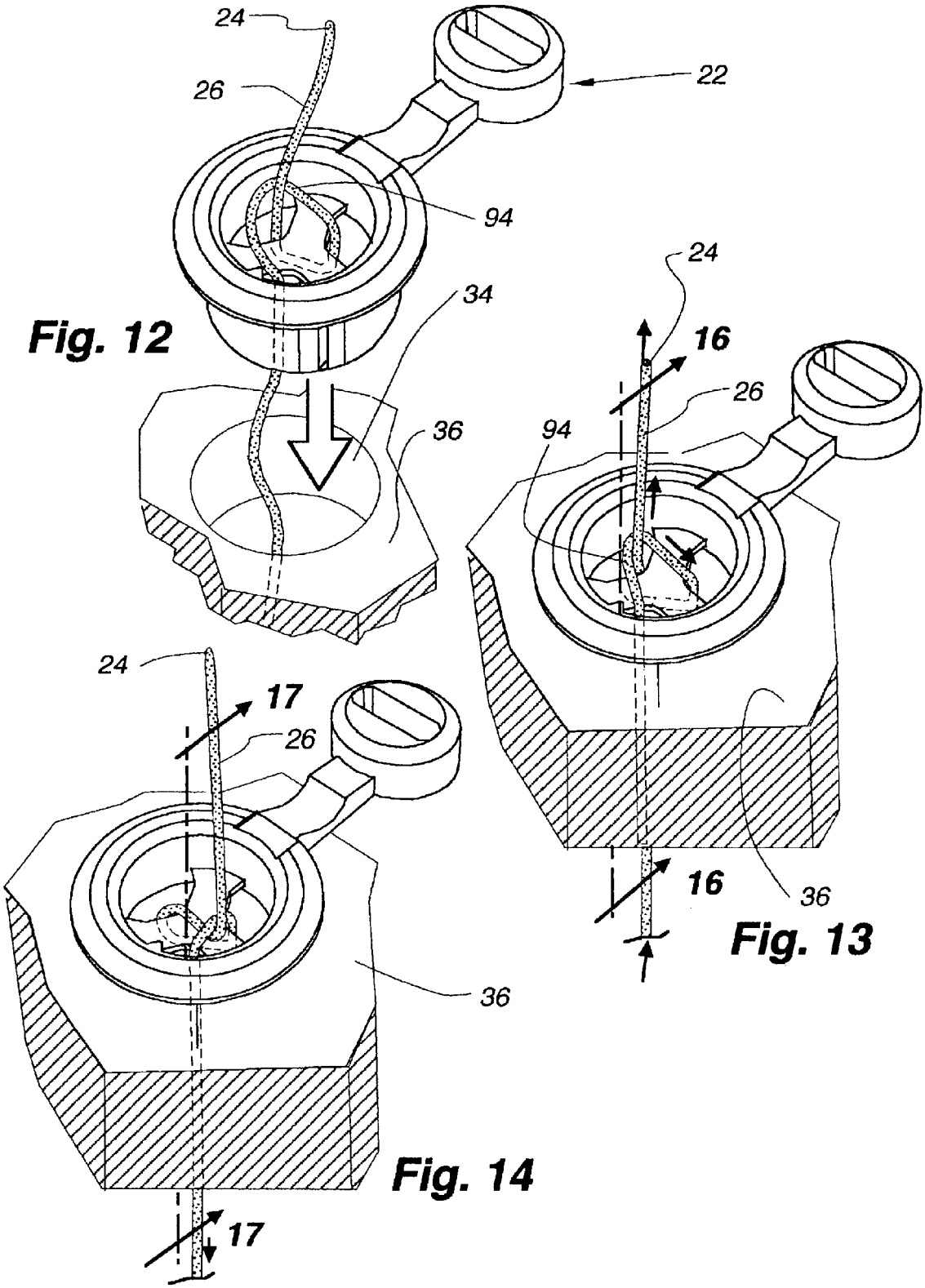
FIGS. 13–15 are isometric operational views illustrating relative movement between the operative element and the anchor of FIG. 1.
Figure 15:
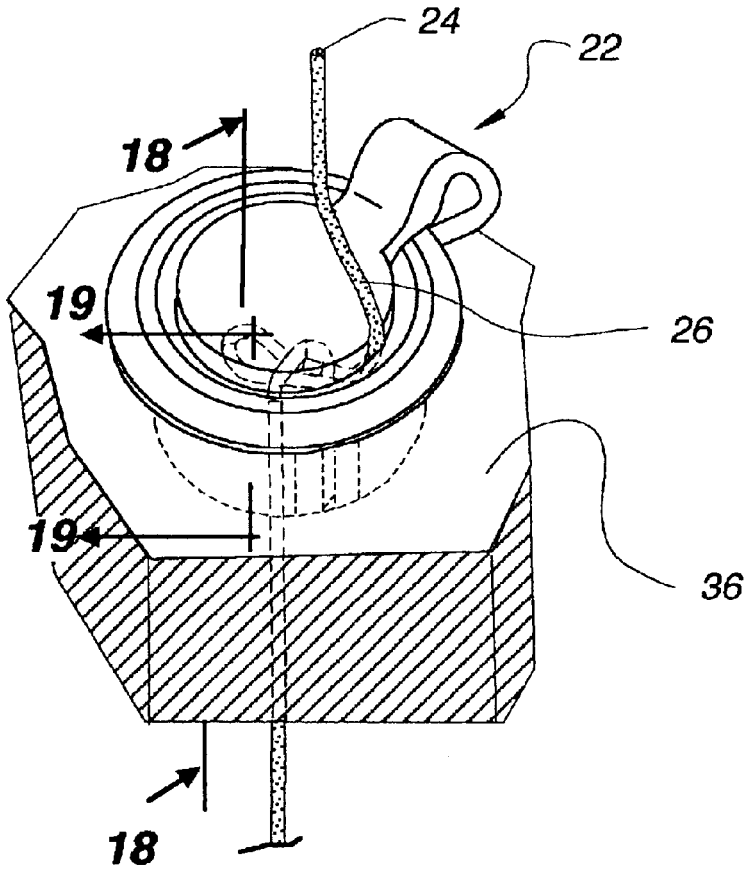

A loop 94 is maintained above the open top 40 of the body 38 before the free end 24 of the lift cord 26 is again reinserted upwardly into the body through the remaining passage 76 as shown in FIG. 11. The free end of the lift cord is then passed through the loop 94. As shown in FIG. 12, the free end can then be pulled to shorten the loop until the loop lies closely across the top of the ribs 44 as shown in FIG. 13. With the lift cord thereby threaded into and connected to the anchor 22, the anchor can be inserted into the associated opening 34 in the end 36 of the bottom rail 30 until the end of the bottom rail engages the flange 46 which defines a stop to properly position the anchor in the bottom rail.

Figure 16:
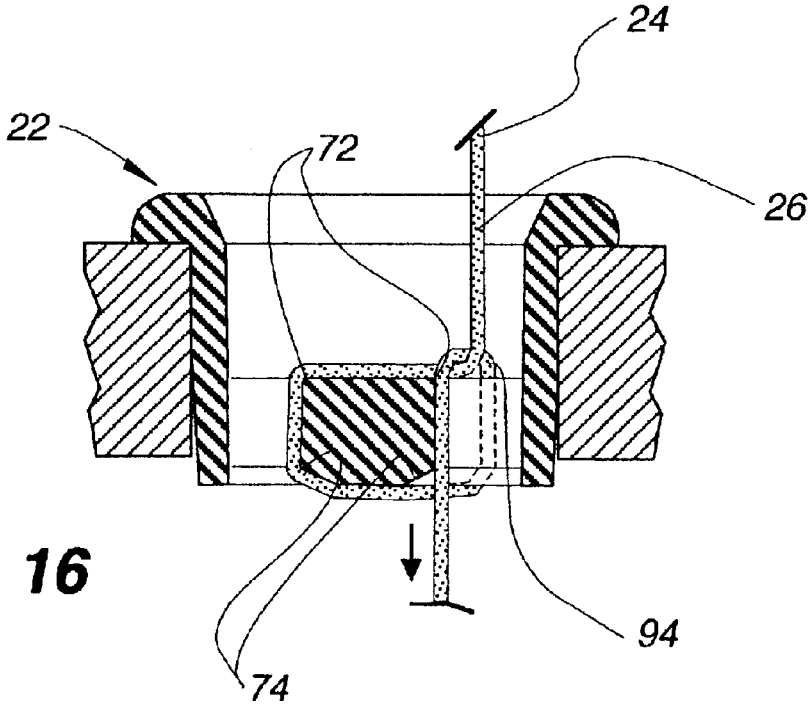
FIG. 16 is a section taken along line 16—16 of FIG. 13.
Figure 17:
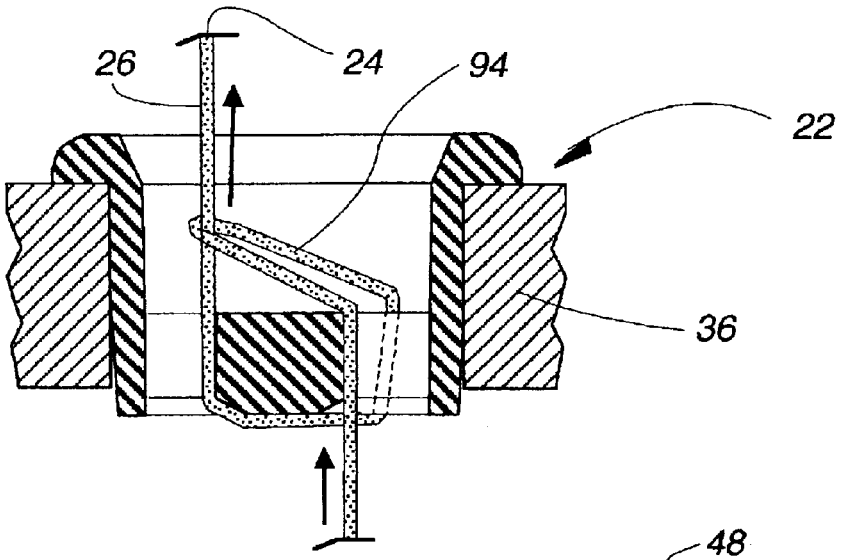
FIG. 17 is a section taken along line 17—17 of FIG. 14.
Figure 18:
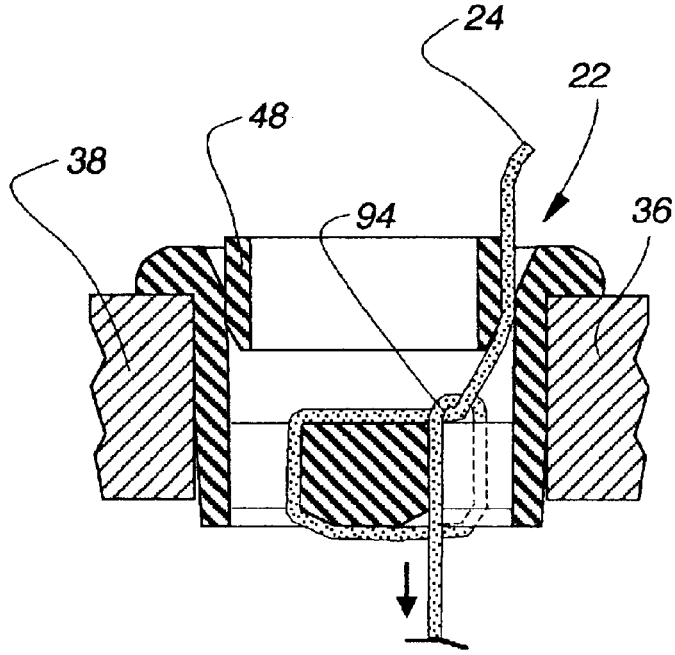
FIG. 18 is a section similar to FIG. 16 with the cap having been inserted into the elongated hollow body of the anchor.
Figure 19:
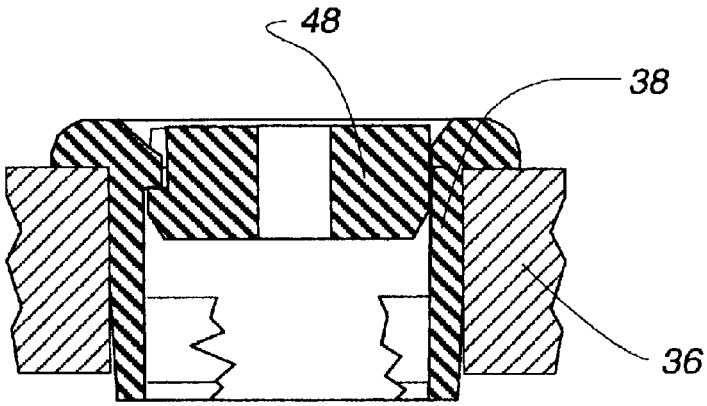
FIG. 19 is a fragmentary section taken along line 19—19 of FIG. 15.
Figure 20:
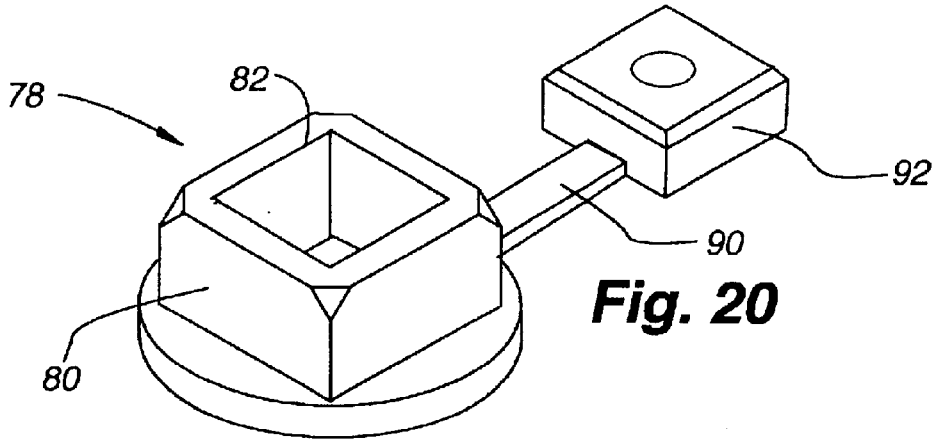
FIG. 20 is an isometric of an alternative embodiment of the anchor of the present invention wherein the anchor is of square cross-section.
Figure 21:
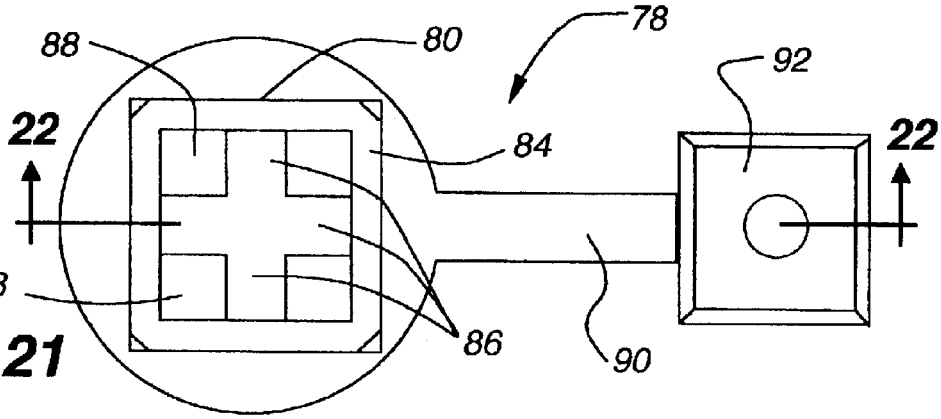
FIG. 21 is a top plan view of the anchor shown in FIG. 20.
Figure 22:
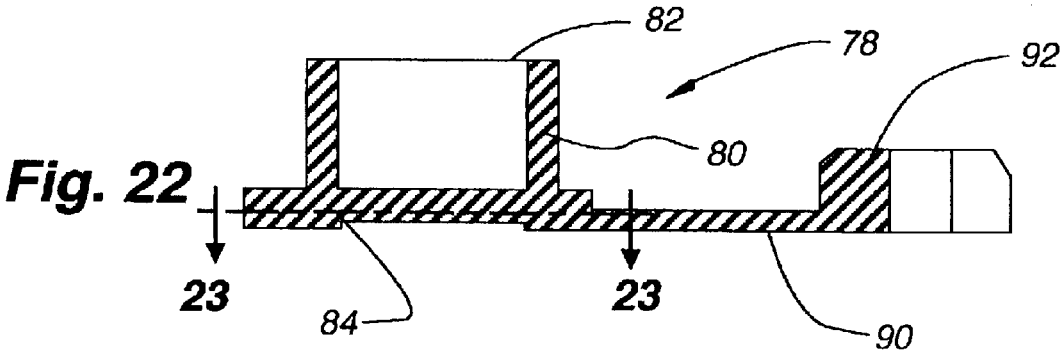
FIG. 22 is a section taken along line 22—22 of FIG. 21.
Figure 23:
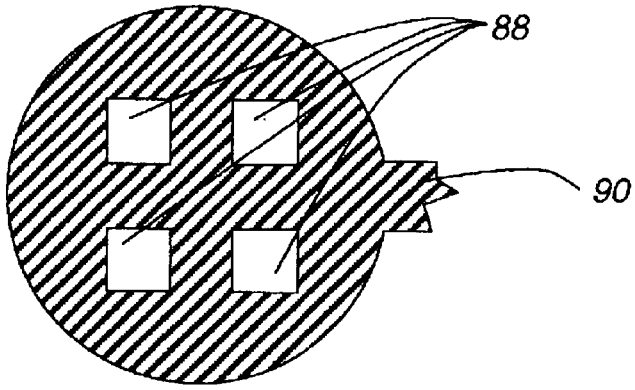
FIG. 23 is an enlarged fragmentary section taken along line 23—23 of FIG. 22.

With reference to FIGS. 14–18, the lift cord 26 can subsequently be desirably positioned along its length relative to the anchor 22 by pulling on the free end 24 of the lift cord as seen in FIG. 17 remembering that the free end is actually pointed horizontally away from the end wall 36 in reality rather than upwardly as illustrated. By pulling on the free end of the lift cord, it is allowed to slide easily across the beveled edges 74 of the ribs in the bottom end 42 of the anchor and the loop 94 through which the free edge passes becomes loosened. It will therefore be appreciated that by pulling on the free end, the effective length of the lift cord from the head rail 28 to the bottom rail 30 can be shortened until it is at a desired length corresponding to the spacing between top and bottom frame members (not shown) of the architectural opening in which the covering is mounted. If the lift cord was pulled too far, it can be fed loosely back into the anchor such that the weight of the bottom rail or alternatively a pulling force on the bottom rail, will cause the bottom rail to slide along the lift cord in the opposite direction toward the free end of the lift cord thereby permitting the bottom rail to be lowered or spaced a greater distance from the headrail. Once the desired positioning has been obtained for the lift cord relative to the anchor, the bottom rail can be pulled downwardly causing the lift cord to be cinched tightly against the ribs around which it is wrapped as illustrated in FIG. 16. It will there be appreciated that the squared top edges 72 of the ribs serve to grip the lift cord to hold it in position. Finally, as illustrated in FIG. 18, the cap 48 can be pivoted into alignment with the body 38 and forced into the open top end of the body to pinch the lift cord between the cap and the internal surface 56 of the body to further secure the relationship of the anchor to the lift cord.

By following the same procedure for each lift cord, it will be appreciated they can be easily connected to associated anchors at precisely the same location along the length of the lift cords so that each lift cord after being suitably connected to its associated anchor has an identical effective length between the head rail and the bottom rail. Should the effective length of any lift cord need to be adjusted after the cap has been inserted into the open end of the body, a screwdriver or other similar implement can be inserted into the slot in the cap to provide leverage for overcoming the releasable connection of the cap to the body.

As mentioned previously, the body 38 of the anchor 22 has diametrically opposed longitudinally extending ribs 70 which are radially spaced from the longitudinal axis of the body a slightly greater distance than the radius of the outer surface of the body. The ribs 70 therefore serve to grip the surface in the bottom rail 30 surrounding the associated opening 34 in which it is inserted to hold the anchor in position within the bottom rail. It will also be appreciated, if the main body has a square cross-section, as shown in FIGS. 20–23 and described previously, the opposite square corners of the body would grip the surface of the hole in a similar manner.

Although the present invention has been described with a certain degree of particularity, it is understood the disclosure has been made by way of example, and changes in detail or structure may be made without departing from the spirit of the invention as defined in the appended claims.

What is claimed is:

1. A covering for an architectural opening comprising in combination a headrail, a bottom rail having an opening therein, a blind extending from said headrail to said bottom rail, a flexible operating element extending from said headrail to said bottom rail and an anchor seated in said opening in said bottom rail, said anchor comprising an elongated hollow body having a first open end and a second end, said second end having at least one rib to define a plurality of passageways through said second end, and a removable cap adapted to be releasably seated in said first open end, said operating element having a first end inserted into said hollow body through said second end of said hollow body, said first end of said operating element being wrapped around said at least one rib and being free to be passed through said first open end, said removable cap being adapted to confine said free end in said first open end of said hollow body if said first end of said element is passed through said first open end wherein said anchor connects the operating element to said bottom rail at a selected location along the length of said operating element.

2. The covering of claim 1 wherein there are a plurality of said ribs.

3. The covering of claim 1 wherein said hollow body is generally of cylindrical configuration.

4. The covering of claim 3 wherein there are a plurality of said ribs radiating from a central area of said hollow body.

5. The covering of claim 1 wherein said hollow body is of square cross-section.

6. The covering of claim 5 wherein there are a plurality of ribs radiating from a central area of said hollow body.

7. The covering of claim 6 wherein said ribs terminate in the corners of said hollow body.

8. The covering of claim 1 wherein said at least one rib has edges of different configuration relative to each other and wherein at feast one of said edges is configured to grip said operating cord more than other of said edges.

9. The covering of claim 1 wherein said at least one rib has at least one edge of squared configuration and at least another edge that is beveled.

10. The combination of an anchor and an operating element for securing the element to an operative component of a covering for an architectural opening comprising in combination:

an anchor having an elongated hollow body with a first open end and a second end, said second end having at least one rib to define a plurality of passageways through said second end, and a removable cap adapted to be releasably seated in said first open end, and an operating element having a first end, said first end of said element being inserted into said hollow body through said second end of said hollow body, said first end of said operating element being wrapped around said at least one rib and being free to be passed through said first open end, said removable cap being adapted to confine said first end of said element in said first open end of said hollow body if said first end of said element is passed through said first open end.

11. The combination of claim 10 wherein there are a plurality of said ribs.

12. The combination of claim 10 wherein said hollow body is generally of cylindrical configuration.

13. The combination of claim 12 wherein there are a plurality of said ribs radiating from a central area of said hollow body.

14. The combination of claim 10 wherein said hollow body is of square cross-section.

15. The combination of claim 14 wherein there are a plurality of ribs radiating from a central area of said hollow body.

16. The combination of claim 15 wherein said ribs terminate in the corners of said hollow body.

* * * * *